US010059541B2

(12) United States Patent
Kondo

(10) Patent No.: US 10,059,541 B2
(45) Date of Patent: Aug. 28, 2018

(54) SHEET TRAY AND IMAGE FORMING APPARATUS

(71) Applicant: BROTHER KOGYO KABUSHIKI KAISHA, Nagoya-shi, Aichi-ken (JP)

(72) Inventor: Kei Kondo, Nisshin (JP)

(73) Assignee: BROTHER KOGYO KABUSHIKI KAISHA, Nagoya-Shi, Aichi-Ken (JP)

( * ) Notice: Subject to any disclaimer, the term of this patent is extended or adjusted under 35 U.S.C. 154(b) by 17 days.

(21) Appl. No.: 15/380,670

(22) Filed: Dec. 15, 2016

(65) Prior Publication Data

US 2017/0210576 A1 Jul. 27, 2017

(30) Foreign Application Priority Data

Jan. 26, 2016 (JP) ..... 2016-012771

(51) Int. Cl.
*B65H 1/04* (2006.01)

(52) U.S. Cl.
CPC ..... *B65H 1/04* (2013.01); *B65H 2405/10* (2013.01); *B65H 2405/1122* (2013.01); *B65H 2405/1124* (2013.01); *B65H 2405/11425* (2013.01)

(58) Field of Classification Search
CPC .... B65H 2405/1122; B65H 2405/1124; B65H 2405/1142; B65H 2405/11425; B65H 2405/1144
See application file for complete search history.

(56) References Cited

U.S. PATENT DOCUMENTS 7,487,963 B2 * 2/2009 Shiohara ..... B65H 1/04 271/162
8,087,664 B2 * 1/2012 Imai ..... B65H 1/266 271/171
8,286,962 B2 * 10/2012 Tanaka ..... B65H 1/266 271/171
8,770,578 B2 * 7/2014 Yamamoto ..... B65H 3/00 271/171
8,882,377 B2 * 11/2014 Kim ..... B65H 1/266 271/171

(Continued)

FOREIGN PATENT DOCUMENTS

JP 1-209227 A 8/1989
JP 8-169563 A 7/1996

(Continued)

*Primary Examiner* — Jeremy R Severson
(74) *Attorney, Agent, or Firm* — Merchant & Gould P.C.

(57) ABSTRACT

A sheet tray, including a tray body having a bottom plate, and a sheet guide, is provided. The sheet guide includes a guide plate to align sheets at a predetermined position, a lever, a swingable device having a boss and a guide groove, and a stopper pivotably connected with a hinge. The boss guided in the guide groove moves the lever between a first position, wherein the boss is in a first section in the guide groove and the stopper is lowered to an engaged position, with an engageable part being engaged with the bottom plate; and a second position, wherein the boss is in a second section in the guide groove and the stopper is uplifted to a separated position with the engageable part being separated from the bottom plate. When the lever moves from the first position to the second position, the lever tilts by ascending and pivoting.

19 Claims, 7 Drawing Sheets

(56) References Cited

U.S. PATENT DOCUMENTS

| | | | | |
|---|---|---|---|---|
| 8,998,198 | B2 * | 4/2015 | Yamajo | B65H 29/70 271/207 |
| 9,580,258 | B1 * | 2/2017 | McFarland | B65H 1/04 |
| 2004/0036208 | A1 * | 2/2004 | Yanagi | B65H 3/0661 271/171 |
| 2012/0080839 | A1 * | 4/2012 | Akimatsu | B65H 1/04 271/253 |
| 2016/0001995 | A1 * | 1/2016 | Sato | B65H 1/266 271/171 |

FOREIGN PATENT DOCUMENTS

| | | | |
|---|---|---|---|
| JP | 9-71328 | A | 3/1997 |
| JP | 2004-196504 | A | 7/2004 |

* cited by examiner

SHEET TRAY AND IMAGE FORMING APPARATUS

CROSS REFERENCE TO RELATED APPLICATION

This application claims priority from Japanese Patent Application No. 2016-012771, filed on Jan. 26, 2016, the entire subject matter of which is incorporated herein by reference.

BACKGROUND

Technical Field

The present invention relates to a sheet tray, in which a plurality of stacked sheets may align with a predetermined position, and to an image forming apparatus having the sheet tray.

Related Art

An image forming apparatus, e.g., a multifunction peripheral device and a printer, may be equipped with a sheet tray that feeds sheets to an image forming unit. The sheet tray may include a lifting plate to uplift the sheets stacked thereon to feed the sheets, from a topmost one of the sheets, one after another to the image forming unit. The sheet tray may have a sheet guide including a side guide and a rear guide, which may be arranged to contact lateral edges and rearward edge of the sheets. The side guide and the rear guide may be slidable along a bottom of the sheet tray so that the side and rear guides may be moved to fit with the edges of the sheets and the sheets may be placed at a predetermined position in the sheet tray.

The sheet guide may include a locking device with a lever, which may be operated by a user and pivot about a pivot shaft, and a stopper, which may move along with the pivoting motion of the lever. The pivot shaft may be fixed to the sheet tray. For example, when the lever is moved to pivot about the pivot shaft, the stopper locked to a bottom plate of the sheet tray may be uplifted to be separated from the bottom plate so that the sheet guide may be released from the lock to be movable. Thus, the pivoting motion of the lever may be converted into a linear motion to uplift the stopper. In order to convert the pivoting motion to the linear motion, the locking device may include an L-shaped piece that may be pivotably attached to the pivot shaft at a bended corner and extend from the pivot shaft to the stopper. Further, in order to uplift the stopper for a substantial amount from the bottom plate, the L-shaped piece may have a substantial length. Therefore, the sheet guide may require a substantial volume of space, in which the L-shaped piece is movable. Specifically, thickness, e.g., a volume in a direction orthogonally to a planar direction, of the sheet guide may tend to increase so that the L-shaped piece may pivot therein. With the increased thickness, reduction of an overall volume of the sheet tray may have been difficult.

SUMMARY

The present disclosure is advantageous in that a downsized sheet tray with a thinner sheet guide may be provided.

According to an aspect of the present disclosure, a sheet tray, including a tray body with a bottom plate, on which sheets are stackable, and a sheet guide disposed on the bottom plate, is provided. The sheet guide includes a guide plate, a lever, a swingable device, and a stopper. The guide plate is configured to slidably move on the bottom plate and to contact edges of the sheets on the bottom plate to align the sheets at a predetermined position. The swingable device includes a boss and a guide groove, in which the boss is inserted. One of the boss and the guide groove is formed in the guide plate, and the other of the boss and the guide groove is formed in the lever. The boss is configured to be guided in the guide groove to move the lever swingably. The stopper is pivotably connected with the lever through a hinge. The stopper includes an engageable part configured to engage with the bottom plate. The boss being guided in the guide groove moves the lever to swing between a first position, in which the boss is in a first section in the guide groove, and the stopper is lowered to an engaged position where the engageable part engages with the bottom plate; and a second position, in which the boss is in a second section in the guide groove, and the stopper is uplifted to a separated position where the engageable part is separated from the bottom plate. When the lever is moved from the first position to the second position, the lever tilts by ascending and pivoting about a pivot axis of the hinge.

According to another aspect of the present disclosure, an image forming apparatus, including an image forming unit configured to form images on sheets and a sheet tray, is provided. The sheet tray includes a tray body with a bottom plate, on which sheets are stackable, and a sheet guide disposed on the bottom plate. The sheet guide includes a guide plate, a lever, a swingable device, and a stopper. The guide plate is configured to slidably move on the bottom plate and to contact edges of the sheets on the bottom plate to align the sheets at a predetermined position. The swingable device includes a boss and a guide groove, in which the boss is inserted. One of the boss and the guide groove is formed in the guide plate, and the other of the boss and the guide groove is formed in the lever. The boss is configured to be guided in the guide groove to move the lever swingably. The stopper is pivotably connected with the lever through a hinge. The stopper includes an engageable part configured to engage with the bottom plate. The boss being guided in the guide groove moves the lever to swing between a first position, in which the boss is in a first section in the guide groove, and the stopper is lowered to an engaged position where the engageable part engages with the bottom plate; and a second position, in which the boss is in a second section in the guide groove, and the stopper is uplifted to a separated position where the engageable part is separated from the bottom plate. When the lever is moved from the first position to the second position, the lever tilts by ascending and pivoting about a pivot axis of the hinge.

According to another aspect of the present disclosure, a sheet tray, including a tray body with a bottom plate, on which sheets are stackable, and a sheet guide disposed on the bottom plate, is provided. The bottom plate includes a guide plate and a stopper unit. The guide plate configured to slidably move on the bottom plate and to contact edges of the sheets on the bottom plate to align the sheets at a predetermined position. The stopper unit includes a lever and a stopper pivotably connected with the lever. The stopper includes an engageable part configured to engage with the bottom plate. The guide plate includes one of a boss and a guide groove in which the boss is inserted, and the stopper unit includes the other of the boss and the guide groove. The boss is configured to be guided in the guide groove to move the lever swingably. The boss being guided in the guide groove moves the lever to swing between a first position, in which the boss is in a first section in the guide groove, and the stopper is lowered to an engaged position where the engageable part engages with the bottom plate; and a second position, in which the boss is in a second section in the guide groove, and the stopper is uplifted to a separated position where the engageable part is separated from the bottom plate. When the lever is moved from the first position to the second position, the lever tilts by ascending and pivoting.

BRIEF DESCRIPTION OF THE ACCOMPANYING DRAWINGS

DETAILED DESCRIPTION

Hereinafter, exemplary embodiments of the present invention will be described with reference to the accompanying drawings.

Overall Configuration of an Image Forming Apparatus in a First Embodiment

Figure 1:
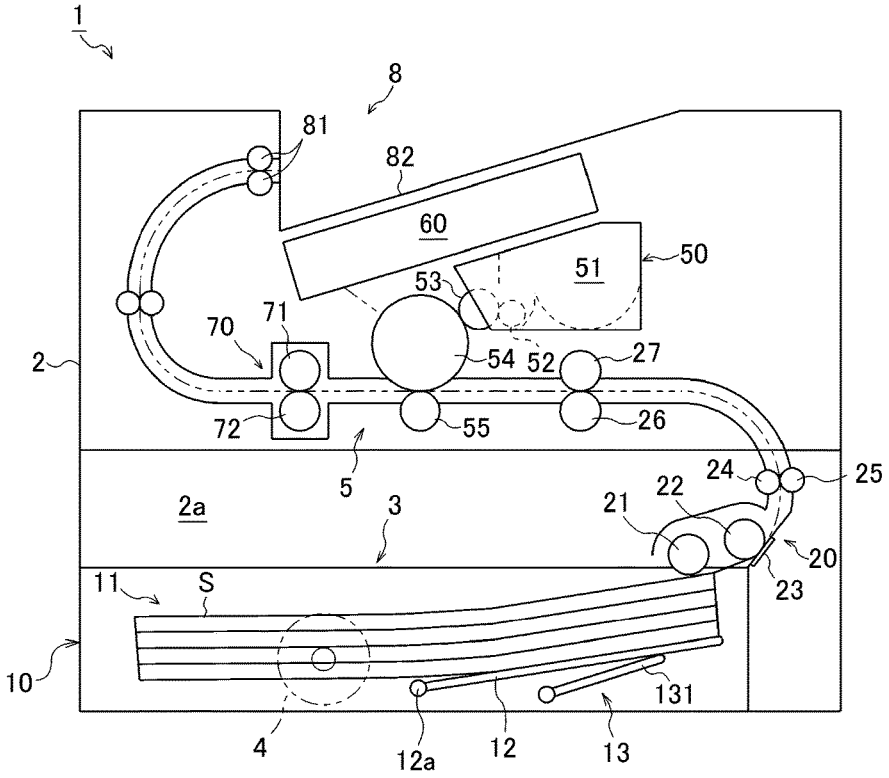
FIG. 1 is a cross-sectional side view of an image forming apparatus according to a first embodiment of the present disclosure.

As shown in FIG. 1, the image forming apparatus 1 includes a chassis 2, a feeder unit 3, a motor 4, an image forming unit 5, and a sheet ejection unit 8.

The feeder unit 3 is disposed in a lower position in the image forming apparatus 1 and may convey sheets S therein to the image forming apparatus 5. The image forming unit 5 is disposed at a position downstream from the feeder unit 3 with regard to a conveying direction to convey the sheets S and may form images on the sheets S fed by the feeder unit 3. The sheet ejection unit 8 is disposed at a position downstream from the image forming unit 5 with regard to the conveying direction and may convey the sheets S with the images formed thereon outward to eject outside the image forming apparatus 1.

The feeder unit 3 includes a sheet tray 10, a sheet feeder 20, a conveyer roller 24, and a registration roller 26.

The sheet tray 10 is detachably attached to a sheet-tray mount 2*a*, which is formed at a lower position in the chassis 2. The sheet tray 10 may be pushed into the chassis 2, e.g., from right to left in FIG. 1, to be inserted in the sheet-tray mount 2*a* and placed in an attached position (see FIG. 1) in the image forming apparatus 1. The sheet tray 10 may be pulled outward, e.g., from left to right in FIG. 1, to be detached from the sheet-tray mount 2*a* to be in a detached position (not shown).

The sheet tray 10 includes a tray body 11, in which one or more sheets S may be accommodated; and a lifting plate 12, on which the sheets S may be stacked, to move the sheets S vertically. The sheet tray 10 further includes a plate lifting device 13. The plate lifting device 13 includes a plate lifting member 131 to move the lifting plate 12 vertically and a gear train 132 (see FIG. 2) to transmit driving force from the motor 4 to the plate lifting member 131.

The lifting plate 12 is pivotably supported at a pivot point 12*a* to move vertically. The gear train 132 in the plate lifting device 13 may be driven by the motor 4 to move the plate lifting member 131 to pivot and lift an end of the plate lifting member 131 upward. The plate lifting member 131 lifted upward may lift the lifting plate 12 upward, and the sheets S stacked on the lifting plate 12 may be uplifted to a feeding position shown in FIG. 1.

The feeder device 20 may separate the sheets S stored in the sheet tray 10 one-by-one from the sheet stack and convey the separated sheet S toward the conveyer roller 24. The feeder device 20 includes a pickup roller 21, a separator roller 22, and a separator pad 23.

The pickup roller 21 is disposed at an upper position with respect to the lifting plate 12 and may pick up the sheets S uplifted by the lifting plate 12 to the feeding position. The separator roller 22 is disposed at a position downstream from the pickup roller 22 with regard to the conveying direction. The separator pad 23 is disposed to face the separator roller 22 and is urged against the separator roller 22.

The sheets S picked up by the pickup roller 21 are conveyed to the separator roller 22, where the sheets S may be separated from one another by the separator roller 22 and the separator pad 23. The separated sheets S are conveyed one-by-one toward the conveyer roller 24.

The conveyer roller 24 is disposed at a position downstream from the feeder device 20 with regard to the conveying direction and may apply conveying force to the sheet S. At a position to face the conveyer roller 24, disposed is a dust-remover roller 25. The sheet S conveyed from the feeder device 20 may be nipped by the conveyer roller 24 and the dust-remover roller 25 and further conveyed toward the registration roller 26.

The registration roller 26 is disposed at a position downstream from the conveyer roller 24 with regard to the conveying direction. The registration roller 26, in conjunction with a paired roller 27, may suspend a leading end of the sheet S for a short moment and start conveying the sheet S once again at predetermined timing to convey the sheet S toward an image-transfer position in the image forming unit 5.

The image forming unit 5 includes a processor cartridge 50, in which an image is transferred to the sheet S being fed by the feeder unit 3; an exposure unit 60, in which a surface of a photosensitive drum 54 in the processor cartridge 50 is selectively exposed to light; and a fuser unit 70, in which the image transferred to the sheet S in the processor cartridge 50 is heated and fixed thereon.

The processor cartridge 50 is disposed at an upper position with respect to the sheet-tray mount 2*a* in the chassis 2. The processor cartridge 50 includes a developer agent container 51, a supplier roller 52, a developer roller 53, the photosensitive drum 54, and the transfer roller 55.

In the developer agent container 51, stored is toner being a developer agent. The toner in the developer agent container 51 may be stirred by an agitator (not shown) and carried to the supplier roller 52. The supplier roller 52 may supply the toner carried from the developer agent container 51 to the developer roller 53.

The developer roller 53 is arranged to be in close contact with the supplier roller 52 and may carry the toner, which is supplied by the supplier roller 52 and positively charged by a friction member (not shown). By a bias applier which is not shown, positive developer bias may be applied to the developer roller 53.

The photosensitive drum 24 is arranged to adjoin the developer roller 53. The surface of the photosensitive drum 54 may be positively charged uniformly by a charger (not shown) and exposed selectively by the exposure unit 60 to a laser beam. Electrical potential in areas that are exposed to the laser beam from the exposure unit 60 may be lowered than the other areas that are not exposed to the laser beams so that an electrostatic latent image based on image data may be formed on the photosensitive drum 54. As the positively charged toner from the developer roller 53 is supplied to the lower potential areas on the surface of the photosensitive drum 54, the electrostatic latent image may be developed to be a toner image.

The transfer roller 55 is disposed to face the photosensitive drum 54. By a bias supplier which is not shown, negative transfer bias may be applied to the transfer roller 55. While the transfer bias is applied to the surface of the transfer roller 55, the sheet S may be nipped by the transfer roller 55 and the photosensitive drum 54, on which the toner image is formed, so that the toner image on the surface of the photosensitive drum 54 may be transferred to the sheet S.

The exposure unit 60 includes a laser diode, a polygon mirror, lenses, and reflection mirrors, which are not shown, and may emit the laser beam at the photosensitive drum 54 according to the image data input in the image forming unit 1 so that the surface of the photosensitive drum 54 may be exposed to the laser beam.

The fuser unit 70 includes a heat roller 71 and a pressure roller 72. The heat roller 71 may be rotated by the driving force from the motor 4 and may be heated by a heat source, which is not shown. The pressure roller 72 is arranged to face the heat roller 71 in close contact with the heat roller 71 so that the pressure roller 72 may be rotated by the rotation of the heat roller 71. The heat roller 71 and the pressure roller 72 may nip the sheet S, which has the transferred image thereon, conveyed to the fuser unit 70, and thermally fix the toner image on the sheet S.

The sheet ejection unit 8 includes an ejection roller 81 and an ejection tray 82. The ejection roller 81 includes paired rollers, which may convey the sheet S conveyed from the fuser unit 70 outside the chassis 2. The sheet ejection tray 82 is formed on an upper face of the chassis 2, and the sheets S conveyed outward the chassis 2 by the ejection roller 81 may be ejected and stacked in the sheet ejection tray 82.

[Configuration of the Sheet Tray]

Figure 2:
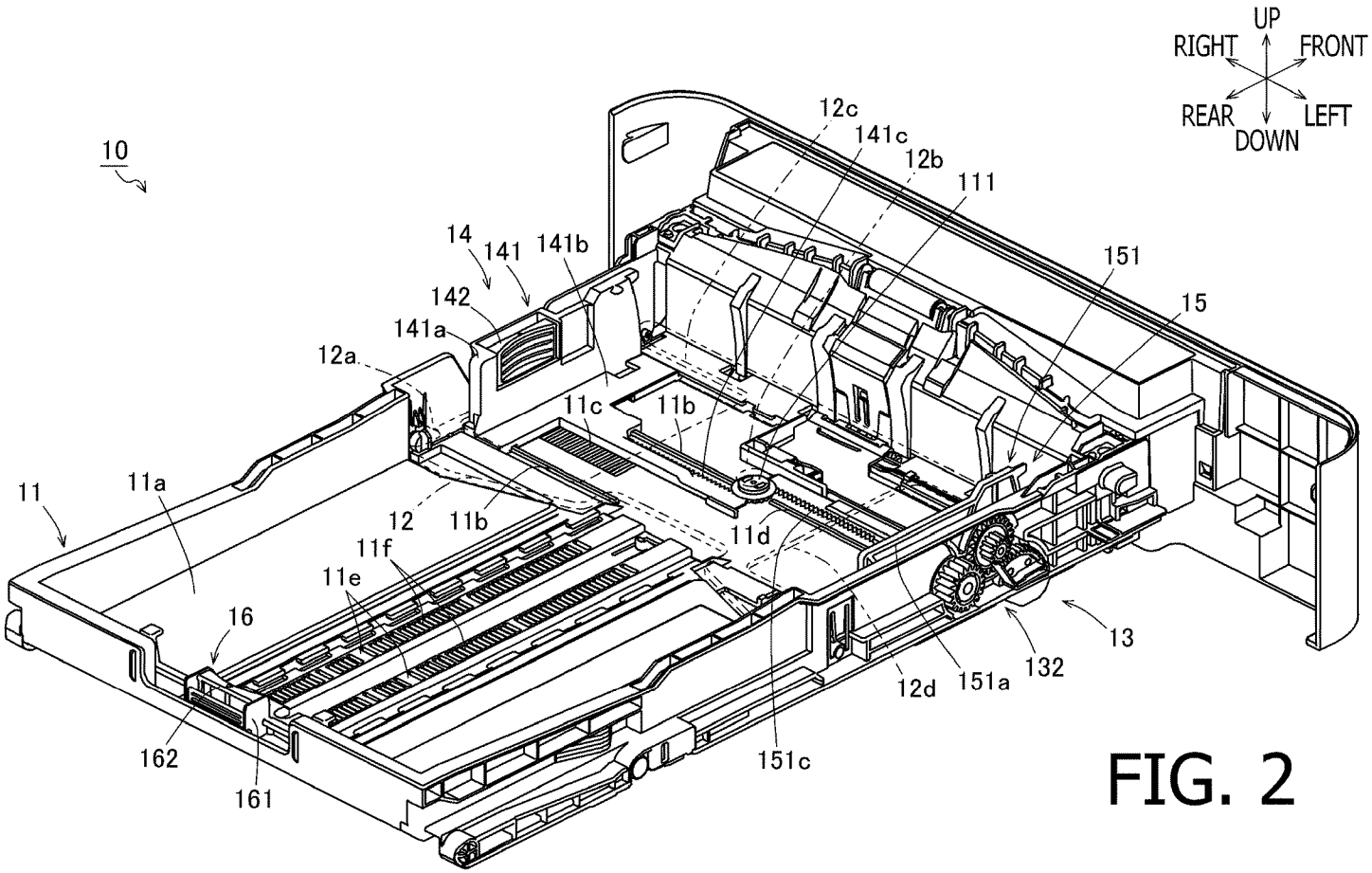
FIG. 2 is a perspective view of a sheet tray according to the first embodiment of the present disclosure.
Figure 3:
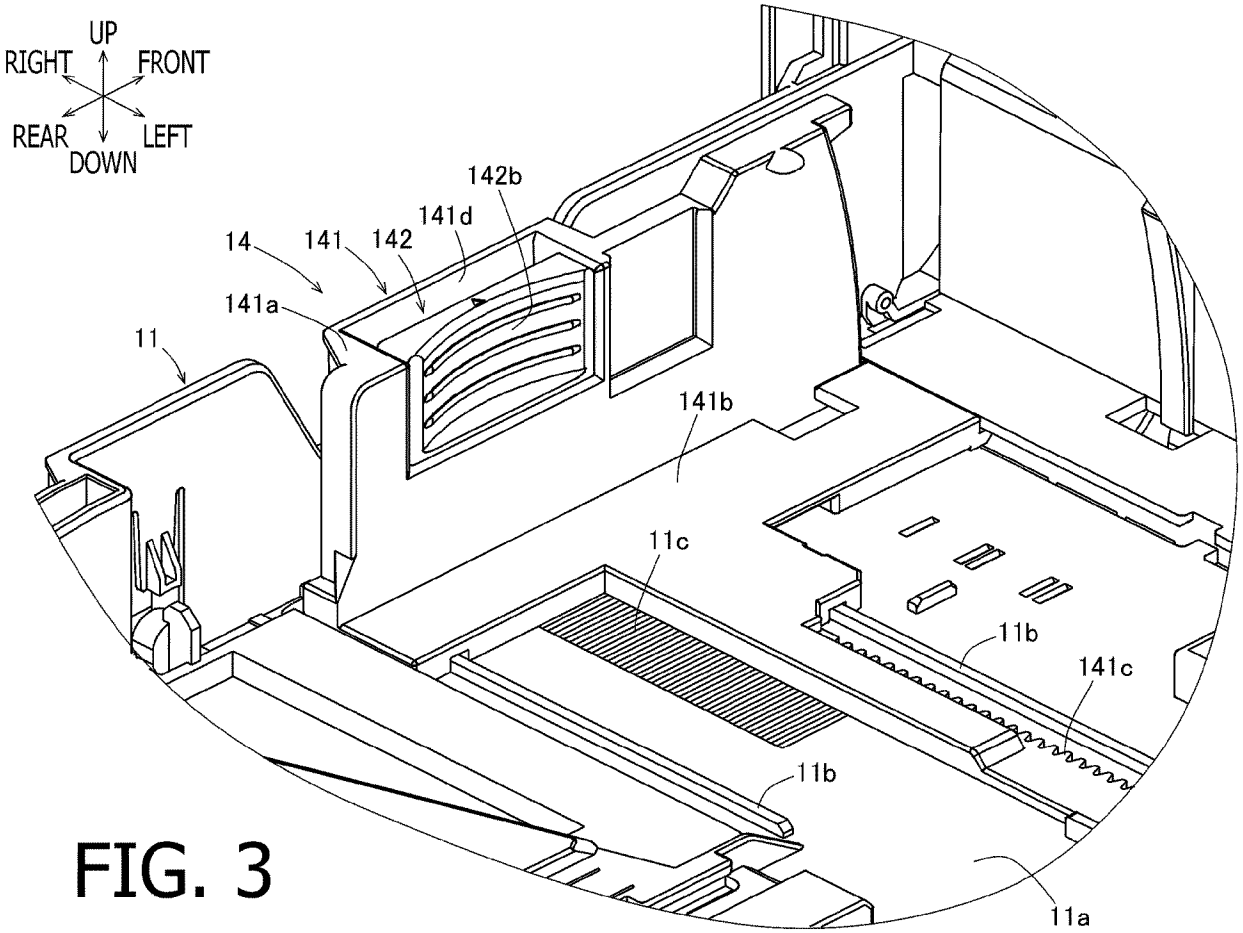
FIG. 3 is an enlarged view of a side guide in the sheet tray according to the first embodiment of the present disclosure.

In the following description, directions concerning the sheet tray 10, including parts and components in the image forming apparatus 1, will be referred to based on a user's position to ordinarily use the image forming apparatus 1 and in accordance with orientation indicated by arrows in the drawings. That is, for example, a viewer's upper-rightward side appearing in FIG. 2 is referred to as a front side of the image forming apparatus 1. A lower-leftward side in FIG. 2 opposite from the front is referred to as a rear side. A side, which corresponds to the viewer's lower-rightward side is referred to as a left-hand side for the user, and an opposite side from the left, which corresponds to the viewer's upper-leftward side, is referred to as a right-hand side for the user. A right-to-left or left-to-right direction of the image forming apparatus 1 may also be referred to as a widthwise direction. A front-to-rear or rear-to-front direction may also be referred to as a front-rear direction. An up-to-down or down-to-up direction in FIG. 2 corresponds to a vertical direction of the image forming apparatus 1.

The sheet tray 10 includes a sheet guide, which may be moved to slide along a line to meet edges of the stacked sheets S, so that the sheets S may be placed in a predetermined position in the sheet tray 10. The sheet guide includes a right-side guide 14, a left-side guide 15, and a rear guide 16, which are arranged on a bottom plate 11*a* of the tray body 11. The right-side guide 14, the left-side guide 15, and the rear guide 16 may be placed to contact edges on the right, the left, and the rear, respectively, of the sheets S.

The right-side guide 14 includes a guide plate 141, which includes an upright portion 141*a* and a bottom portion 141*b* forming an approximate shape of an L. The right-side guide 14 further includes a lever 142, which is swingably coupled to the guide plate 141, and a stopper 143 (see FIG. 4A), which is at a lower position with respect to the lever 142.

The guide plate 141 is arranged to mesh with rails 11*b*, which are formed on the bottom plate 11*a*, at the bottom portion 141*b* to move slidably along the rails 11*b* in the widthwise direction. When the upright portion 141*a* contacts the rightward edges of the sheets S, the rightward edges of the sheets S may align along the upright portion 141*a* at a predetermined position. The bottom portion 141*b* of the guide plate 141 includes a rack 141*c*, which extends leftward along the bottom plate 11*a*. The rack 141*c* is arranged to mesh with a gear 111, which is supported on the bottom plate 11*a*.

The stopper 143 may engage with engageable grooves 11*c*, which are formed on the bottom plate 11*a*. When the lever 142 is in an upright posture (see FIGS. 5A and 6A), the stopper 143 engages with the engageable grooves 11*c* so that a position of the guide plate 141 in the sheet tray 10 may be fixed. When the lever 142 is in an outward tilted posture (see FIGS. 5B and 6B), the stopper 143 is lifted upward so that the stopper 141 may be disengaged from the engageable grooves 11*c*, and the guide plate 141 may be slidable. Thus, the stopper 143 may move in conjunction with the lever 142. In other words, the lever 142 and the stopper may form a stopper unit.

The left-side guide 15 includes a guide plate 151, which includes an upright portion 151*a* and a bottom portion 151*b* forming in an approximate shape of an L. The guide plate 151 is arranged to mesh with rails 11*d*, which are formed on the bottom plate 11*a*, at the bottom portion 151*b* to move slidably along the rails 11*d* in the widthwise direction. When the upright portion 151*a* contacts the leftward edges of the sheets S, the leftward edges of the sheets S may align at the upright portion 151*a* at a predetermined position. The bottom portion 151*b* of the guide plate 151 includes a rack 151*c*, which extends rightward along the bottom plate 11*a*. The rack 151*c* is arranged to mesh with the gear 111.

The right-side guide 14 and the left-side guide 15 are thus coupled with each other through the gear 111 so that the left-side guide 15 may move in conjunction with the right-side guide 14 moving in the widthwise direction. Specifically, when the right-side guide 14 moves leftward, the gear 111 rotates to move the left-side guide 15 rightward; and when the right-side guide 14 moves rightward, the gear 111 rotates to move the left-side guide 15 leftward. Thus, by moving the right-side guide 14, the left-side guide 15 may move accordingly, and the sheets S may be placed in a correct position with regard to the widthwise direction.

The rear guide 16, configured similarly to the right-side guide 14, includes a guide plate 161, a lever 162, and a stopper (not shown). The guide plate 161 is arranged to mesh with rails 11*e*, which are formed on the bottom plate 11*a*, to move slidably along the bottom plate 11*a* in the front-rear direction. When the rear guide 162 contacts the rearward edges of the sheets S, the rearward edges of the sheets S may align with the rear guide 162 at a predetermined position. The stopper may be engaged with engageable grooves 11*f*, which are formed on the rails 11*e*. When the lever 162 is in an upright posture, the stopper 162 may engage with the engageable grooves 11*f* so that a position of the guide plate 161 in the sheet tray 10 is fixed. When the lever 162 is in an outward tilted posture, the stopper may be lifted upward so that the stopper may be disengaged from the engageable grooves 11*f*, and the guide plate 161 may be slidable.

The lifting plate 12 may be a piece of metal and includes apertures 12*b*, 12*c*, 12*d*. The aperture 12*b* is formed at a position coincident with the gear 111. The aperture 12*c* is formed at a position coincident with a movable range for the upright portion 141*a* of the guide plate 141. The aperture 12*d* is formed at a position coincident with a movable range for the upright portion 151*a* of the guide plate 151.

The tray body 11 may preferably be made of polystyrene resin; the guide plates 141, 151, 161 may preferably be made of acrylonitrile-butadiene-styrene resin; and the levers 142, 162, and the stopper 143 may preferably be made of polyacetal resin. With these materials, the tray body 11 and the guide plates 141, 151, 161 may be less deformable; and the levers 142, 162 and the stopper 143 may provide preferable abrasion-resistivity and smooth movability.

[Configuration of the Right-Side Guide]

Below will be described detailed configuration of the right-side guide 14. The description of the right-side guide 14 may equally apply to the rear guide 16. Meanwhile, the left-side guide 15 may employ the configuration of the right-side guide 14 described below, and the right-side guide 14 may employ the configuration of the left-side guide 15. In other words, the configurations of the right-side guide 14 and the left-side guide 15 may be inverted.

Figure 5A:
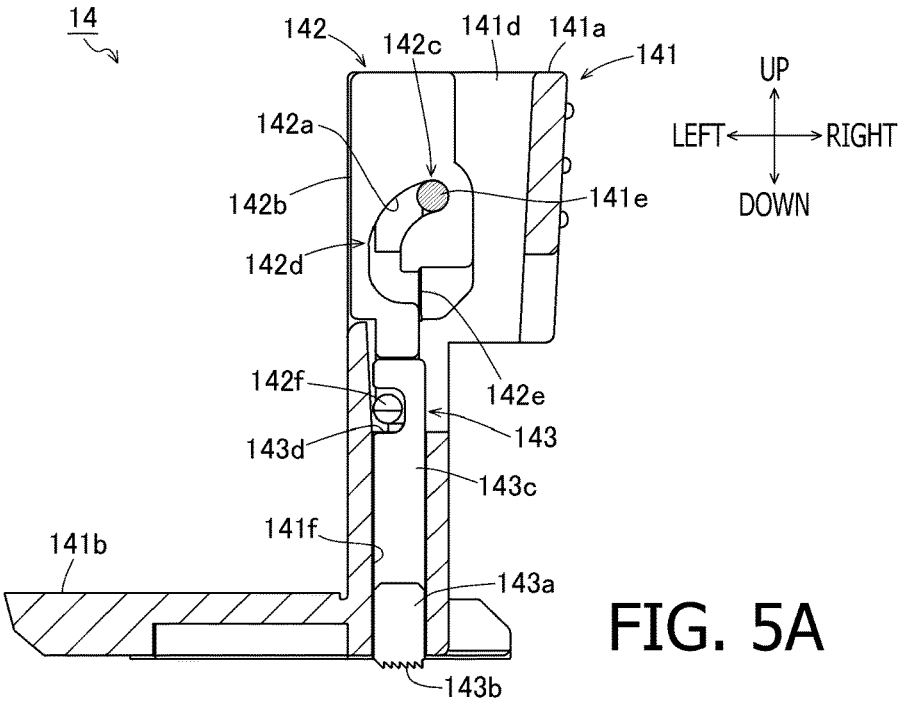
FIG. 5A is a cross-sectional view of the right-side guide viewed at a line A-A shown in FIG. 4A.
Figure 5B:
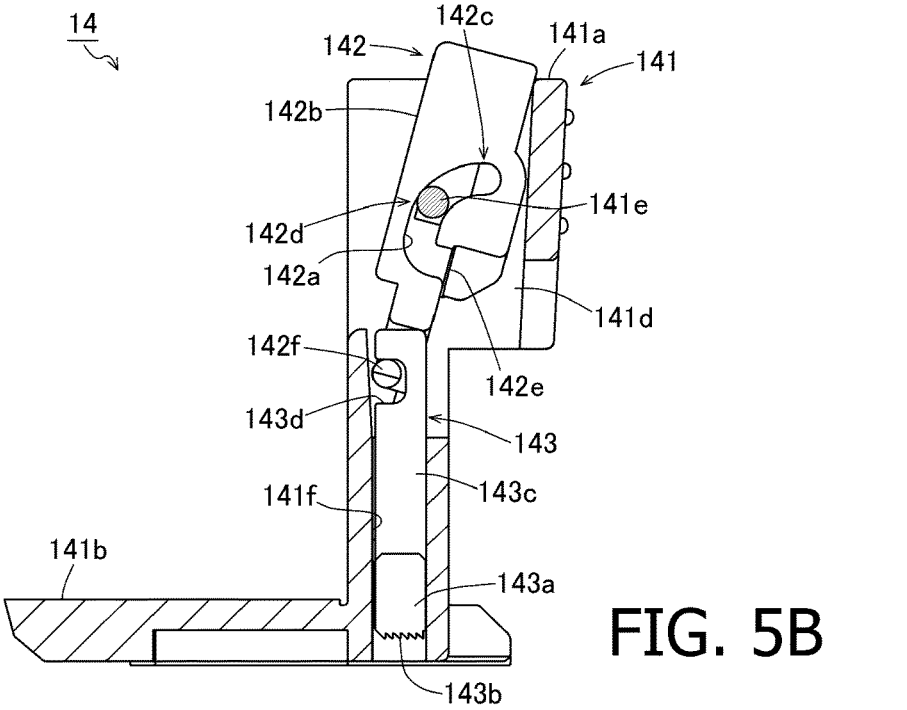
FIG. 5B is a cross-sectional view of the right-side guide viewed at a line C-C shown in FIG. 4B.

The right-side guide 14 is formed to have a lever housing 141*d*, in which the lever 142 is accommodated, in the upright portion 141*a* in the guide plate 141. As shown in FIG. 5A, the lever housing 141*d* may accommodate the lever 142 in the upright posture so that the lever 142 should stay within the upright portion 141*a* without protruding outside the upright portion 141*a*. The lever housing 141*d* is formed to have a room, as shown in FIG. 5B, in which the lever 142 may tilt rightward.

The lever housing 141*d* is formed to have a boss 141*e*, which includes a boss 141*e* on a front side and a boss (unsigned. See FIGS. 4A-4B) on a rear side. In the following description, the boss 141*e* on the front side and the boss on the rear side may be collectively called as the boss 141*e*. Meanwhile, the lever 142 is formed to have a guide groove 142*a*, which includes a guide groove 142*a* on a frontward face and a guide groove (unsigned. See FIGS. 4A-4B) on a rearward face. In the following description, the guide groove 142*e* on the frontward face and the guide groove on the rearward face may be collectively called as the guide groove 142*e*. The boss 141*e* is inserted in the guide groove 142*a* in the lever 142 so that the boss 141*e* may support the lever 142 swingably.

Figure 4A:
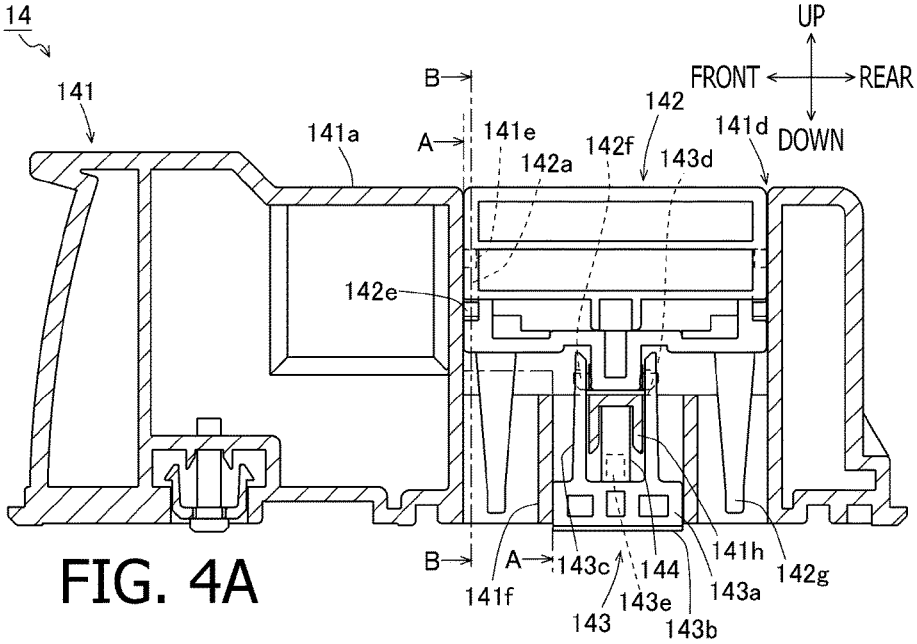
FIG. 4A is a leftward cross-sectional view of a right-side guide viewed from a right-hand side according to the first embodiment of the present disclosure with a lever not being operated.
Figure 4B:
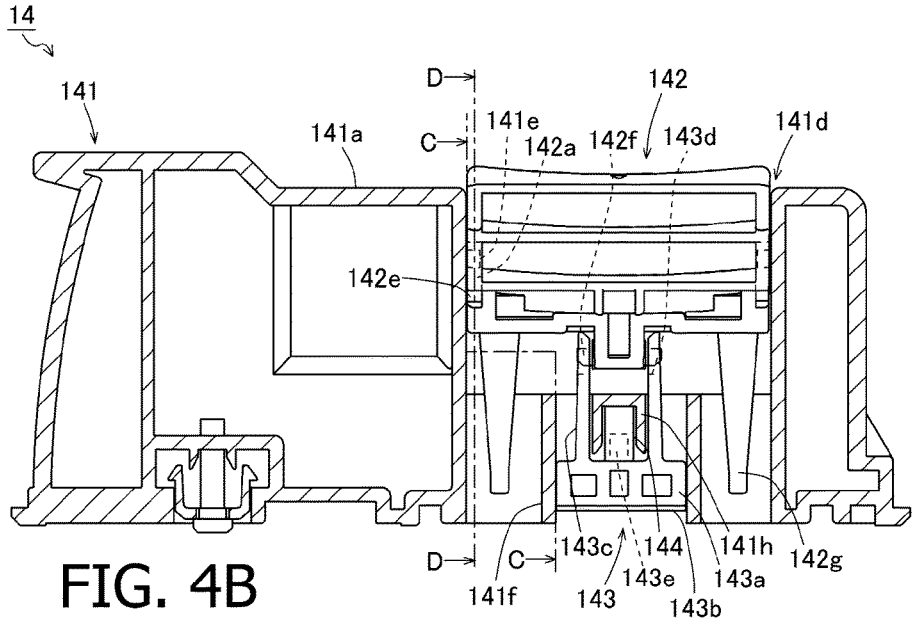
FIG. 4B is a leftward cross-sectional view of the right-side guide viewed from the right-hand side according to the first embodiment of the present disclosure with the lever being operated.

The upright portion 141*a* is further formed to have a stopper housing 141*f*, in which the stopper 143 is accommodated. As shown in FIGS. 4A and 5A, the stopper housing 141*f* is formed to surround peripheral surfaces of the stopper 143 and is open at a bottom. The stopper 143 is movable to slide vertically along inner surfaces of the stopper housing 141*f*. Inside the stopper housing 141, formed is a spring housing 141*h*.

The lever 142 includes the guide groove 142*a*, in which the boss 141*e* may be inserted, on the frontward and rearward faces. Further, the lever 142 includes an operation face 142*b*, which may be pressed by a user, on an inward, e.g., leftward, surface. The guide groove 142*a* is an elongated hole having an upper section 142*c*, a lower section 142*c*, and a boss-introduction opening 142*c*, which are connected continuously. The boss 141*e* may be introduced to the guide groove 142*a* through the boss-introduction opening 141*e*. The guide groove 142*a* may be in a curved form that curves lower-leftward in the upper section 142*a*, which is at an upper-rightward position, toward the lower section 142*d*, which is at a lower-leftward position, and curves lower-rightward in the lower section 142*d* toward the boss-introduction opening 142*c*. In the meantime, the form of the guide groove 142*a* may not necessarily be limited to the curved shape described above but may be, for example, in a convex shape rounded upward or downward, or, for another example, may be formed in straight lines.

The lever 142 attached to the guide plate 141 may be placed in a first position, in which the lever 142 is in the upright posture (see FIG. 5A), and a second position, in which the lever 142 is in the tilted posture (see FIG. 5B). The boss 141*e* and the guide groove 142*a* enable the lever 142 to swing. Specifically, when the lever 142 is in the first position, the boss 141*e* is in the upper section 142*c* in the guide groove 142*a*; and when the lever 142 is in the second position, the boss 141*e* is in the lower section 142*d*. When the user presses the operation face 142*b* outward, e.g., rightward, the guide groove 142*a* may move to relatively guide the boss 141*e* from the upper section 142*c* to the lower section 142*d*. Thereby, the lever 142 may be uplifted and tilt from the first position toward the second position.

The lever 142 further includes a pivot shaft 142*f* at a lower position with respect to the guide groove 142*a*. The pivot shaft 142*f* includes a pivot shaft 142*f* on the frontward face and a pivot shaft (unsigned. See FIGS. 4A-4B) on the rearward face. In the following description, the pivot shaft 142*f* on the frontward face and the pivot shaft on the rearward face may collectively be called as the pivot shaft 142*f*. The pivot shaft 142*f* is formed in a part that protrudes downward at a central area with regard to the front-rear direction of the lever 142 to extend frontward and rearward. The pivot shaft 142*f* is inserted in a pivot groove 143*d* formed in the stopper 143 so that the lever 142 is pivotably supported by the stopper 143 at the pivot shaft 142*f*.

The lever 142 further includes an urging part 142*g*, which may urge the lever 142 toward the first position. The urging part 142*g* includes an urging part (unsigned. See FIGS. 4A-4B) arranged on a front side of the pivot shaft 142*f* and an urging part 142*b* arranged on a rear side of the pivot shaft 142*f*. In the following description, the urging part on the front side and the urging part 142*g* on the rear side may be collectively called as the urging part 142*g*. The urging part 142*g* may be a resin spring, which is formed to project downward from a lower end of the operation face 142*b*. The urging part 142*g* includes a claw 142*h* at a lower end thereof. The claw 142*h* is arranged to contact an inner wall 141*g* on the left of the guide plate 141.

Figure 6A:
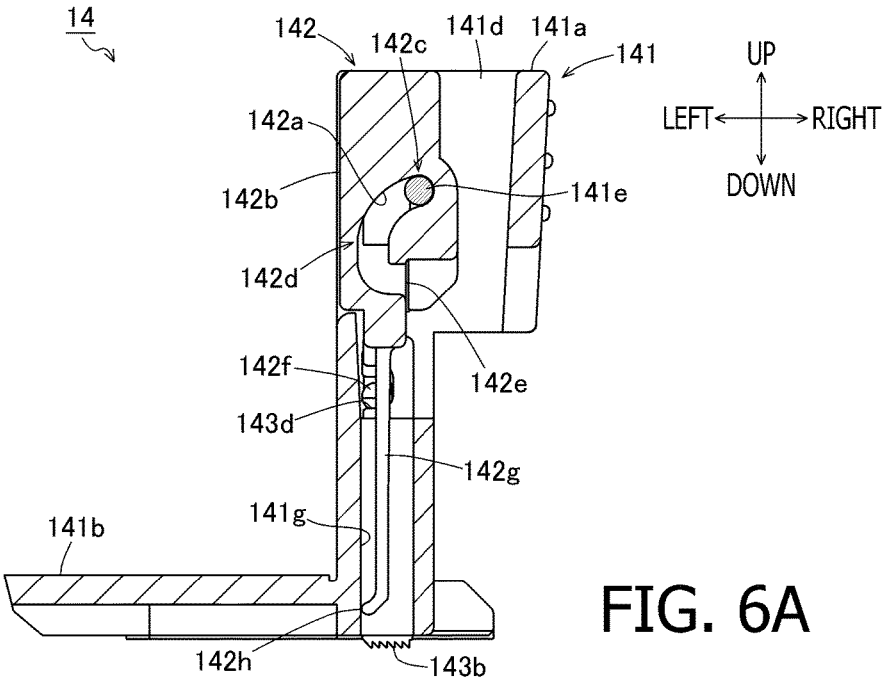
FIG. 6A is a cross-sectional view of the right-side guide viewed at a line B-B shown in FIG. 4A.
Figure 6B:
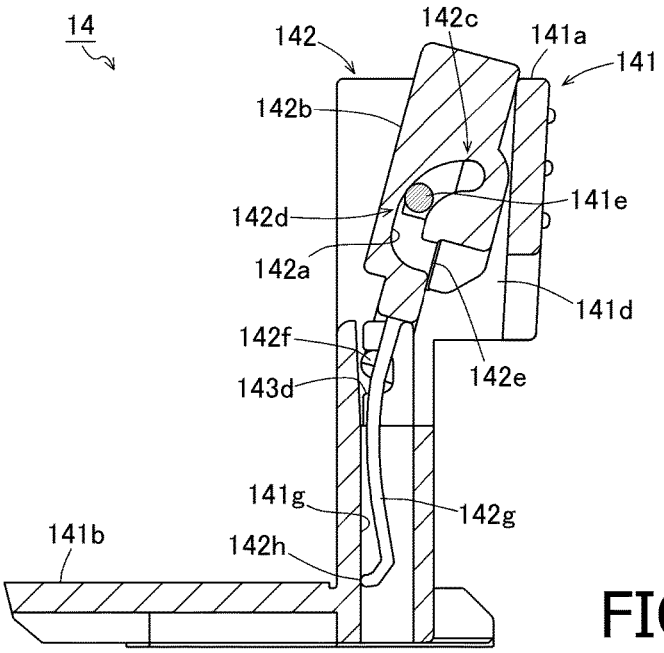
FIG. 6B is a cross-sectional view of the right-side guide viewed at a line D-D shown in FIG. 4B.

Due to resiliency of the urging part 142*g*, the claw 142*h* may stay in contact with the inner wall 141*g* both when the lever 142 is in the first position (see FIG. 6A) and when the lever 142 is in the second position (see FIG. 6B). In other words, the lever 142 may be urged toward the first position at all time by the urging part 142*g*. Therefore, the lever 142 in the first position tends to stay stably in the first position, and the stopper 143 may be prevented from moving or vibrating to collide with the bottom plate 11*a*. Thus, when the lever 142 is in the first position, the lever 142 may be prevented from rattling against the bottom plate 11*a*.

The stopper 143 includes a stopper body 143*a*, an engageable part 143*b*, an elongated part 143*c*, the pivot groove 143*d*, and a spring retainer 143*e*. The engageable part 143*b* is formed at a lower position in the stopper body 143*a*. The extended part 143*c* includes an extended part 143*c* on a front side and an extended part (unsigned. See FIGS. 4A-4B) on a rear side. In the following description, the extended part 143*c* on the front and the extended part on the rear may be collectively called as the extended part 143*c*. The extended part 143*c* extends from an upper end of the stopper body 143*c* upward to the pivot shaft 142*f*. The pivot groove 143*d* includes a pivot groove 143*d* formed in the extended part 143*c* on the front (see FIGS. 5A-5B, for example) and a pivot groove 143*d* formed in the extended part 143*c* on the rear (see FIGS. 4A-4B). In the following description, the pivot groove 143*d* on the front and the pivot groove 143*d* on the rear may be collectively called as the pivot groove 143*d*. The spring retainer 143*e* is formed to project upward from the upper end of the stopper body 143*a* at a central area with regard to the front-rear direction.

The stopper body 143*a* may be in a form of a rectangular block and is accommodated in the stopper housing 141*f*. The stopper body 143*a* is slidable along inner surfaces of the stopper housing 141*f*. The engageable part 143*b* is formed in a serrated shape of saw-teeth, which point downward and align along the widthwise direction. The engageable part 143*b* is engageable with the engageable grooves 11*c* on the bottom plate 11*a*.

The extended part 143*c* is formed to extend from the stopper body 143*c* to reach the pivot shaft 142*f* so that the lever 142 should be supported by the stopper 143 through the extended part 143*c*. The pivot groove 143*d* is formed at an upper position in the extended part 143*c* and is carved rightward from a leftward face of the extended part 143*c*. A height of the pivot groove 143*d* may be greater than a vertical dimension of the swing shaft 142*f* so that a manufactural error that may be caused between the pivot groove 143*d* and the pivot shaft 142*f* may be absorbed by the difference. The pivot shaft 142*f* and the pivot groove 143*d* may serve as a hinge so that, when the user presses the operation face 142*b* of the lever 142 rightward, the stopper 143 may be uplifted together with the lever 142, and the lever 142 may pivot about the pivot shaft 142*f* to tilt rightward.

The spring retainer 143*e* may be a cylindrical projection, and a compressive coil spring 144 is arranged around an outer circumference of the spring retainer 143*e*. A lower end of the compressive coil spring 144 is supported on the upper face of the stopper body 143*a*, and an upper end of the compressive coil spring 144 is inserted to be supported in a spring housing 141*a*, which is formed in the stopper housing 141*f*. When the stopper 143 is in an engaged position (see FIG. 4A), in which the engageable part 143*b* is engaged with the engageable grooves 11*c*, the compressive coil spring 144 may urge the stopper 143 downward against the bottom plate 11 so that the engageable part 143*b* and the engageable ridges 143*b* may be engaged more stably. On the other hand, when the stopper 143 is in a separated position (see FIG. 4B), in which the stopper 143 is uplifted and the engageable part 143*b* is separated from the engageable grooves 11*c*, the compressive coil spring 144 may be compressed. When the user releases the operation face 142*b* of the lever 142, the stopper 143 may be lowered by resiliency of the compressive coil spring 144, and the lever 142 may return to the upright posture.

With the configuration of the right-side guide 14 described above, the lever 142 may tilt and ascend at the same time. Therefore, a movable range for the lever 142 to move in the widthwise direction may be reduced compared to the conventional lever that includes the L-shaped piece; in other words, it may not be necessary that the lever 142 be formed in the L-shape. Accordingly, the thickness of the right-side guide 14 may be reduced, and the sheet tray 10 may be downsized.

Further, with the lever 142 that may ascend and tilt at the same time, the lever 142 may not have a portion that sinks downward. Therefore, a part of the lifting plate 12 that encloses the right-side guide 14 from right may not collide with the movable range of the lever 142 when the lifting plate 12 is uplifted. Thus, the lever 142 may not necessarily be arranged apart from the lifting plate 12, and the right-side guide 14 may be downsized. Accordingly, the sheet tray 10 may be downsized.

[Behavior of the Right-Side Guide]

While the lever 142 is not operated by the user, as shown FIGS. 4A, 5A, and 6A, the boss 141*e* is in the upper section 142*c* in the guide groove 142*a*; the lever 142 is in the upright posture in the first position; and the stopper 143 is lowered to the engaged position where the engageable part 143*b* engages with the engageable grooves 11*c*. In this state, the position of the right-side guide 14 is fixed.

The user may pinch the lever 142 by, for example, fingers of a right hand, and push the lever 142 with a thumb outward. When the lever 142 is pressed, the boss 141*e* may move with respect to the lever 142 along the guide groove 142*a* to reach the lower section 142*d* (see FIG. 5B). Thereby, the lever 142 together with the stopper 143 may be uplifted and pivot about the pivot shaft 142*f* to tilt rightward to be away from the sheets S in the tray body 11. Meanwhile, the urging part 142*g* in the lever 142 may remain in contact with the inner wall 141*g* of the guide plate 141 (see FIG. 6B). When the stopper 143 ascends, the engageable part 143*b* may be moved from the engaged position to the separated position. Meanwhile, the compressive coil spring 144 may be compressed (see FIG. 4B). In this state, the right-side guide 14 may be movable to slide in the widthwise direction so that the user may move the right-side guide 14 to a position to fit with the sheets S.

[Benefits]

According to the embodiment of the image forming apparatus 1 described above, the sheet tray 10 includes the tray body 11, in which sheets are stackable, the guide plate 141, the lever 142, the swingable device including the boss 141*e* and the guide groove 142*a* in which the boss 141*e* is inserted, and the stopper 143. The guide plate 141 may slidably move on the bottom plate 11*a* in the tray body 11 and contact edges of the sheets S to align at the predetermined position. The boss 141*e* is formed in the guide plate 141, and the guide groove 142*a* is formed in the lever 142. The boss 141*e* may be guided in the guide groove 142*a* to move the lever 142 swingably. The stopper 143 is pivotably connected with the lever 142 through the hinge, which includes the pivot shaft 142*f* and the pivot groove 143*d*, and includes the engageable part 143*b* to engage with the bottom plate 11*a*. The boss 141*e* being guided in the guide groove 142*a* may move the lever 142 to swing between the first position, in which the boss 141*e* is in the upper section 142*c* in the guide groove 142*a*, and the stopper 143 is lowered to the engaged position where the engageable part 143*b* engages with the bottom plate 11*a*; and the second position, in which the boss 141*e* is in the lower section 142*d* in the guide groove 142*a*, and the stopper 143 is uplifted to the separated position where the engageable part 143*b* is separated from the bottom plate 11*a*. When the lever 142 is moved from the first position to the second position, the lever 142 may tilt by ascending and pivoting about the pivot shaft 142*f*.

Thus, the lever 142 moved from the first position to the second position may release the stopper 143 from the engagement with the bottom plate 11*a* and allow the guide plate 141 to slidably move on the bottom plate 11*a*. The lever 142 guided by the behavior of the guide groove 142*a* and the boss 141*e* may ascend and tilt at the same time. In this regard, the L-shaped piece, which may be arranged to extend from a pivot shaft of the lever to a stopper and may have been required in the conventional guide plate to enable the lever to tilt without ascending, is not required. The guide plate 142 does not require the larger space, in which the L-shaped piece should be accommodated, but the guide plate 142 may be accommodated in a smaller volume of space. Therefore, with the smaller volume of space, the sheet tray 10 may be downsized.

In another aspect, the sheet tray 10 includes the tray body 11, in which sheets S are stackable, the guide plate 141, the stopper unit including the lever 142 and the stopper 143. The guide plate 141 may slidably move on the bottom plate 11*a* in the tray body 11 and contact the edges of the sheets S to align at the predetermined position. The stopper 143 is pivotably connected with the lever 142 and includes the engageable part 143*b* to engage with the bottom plate 11*a*. The guide plate 141 includes the boss 141*e*, and the lever 142 includes the guide groove 142*a*, in which the boss 141*e* is inserted. The boss 141*e* may be guided in the guide groove 142*a* to move the lever 142 swingably. The boss 141*e* being guided in the guide groove 142*a* may move the lever 142 to swing between the first position, in which the boss 141*e* is in the upper section 142*c* in the guide groove 142*a*, and the stopper 143 is lowered to the engaged position where the engageable part 143*b* engages with the bottom plate 11*a*; and the second position, in which the boss 141*e* is in the second section in the guide groove 142*a*, and the stopper 143 is uplifted to the separated position where the engageable part 143*b* is separated from the bottom plate 11*a*. When the lever 142 is moved from the first position to the second position, the lever 142 may tilt by ascending and pivoting.

The image forming apparatus 1 may further include the engageable grooves 11*c* formed on the bottom plate 11*a*. The engageable grooves 11*c* may engage with the engageable part 143*b* when the lever 142 is in the first position. The image forming apparatus 1 may further include the compressive coil spring 144, which may urge the engageable part 143*b* against the engageable grooves 11*c*.

Thus, the compressive coil spring 144 may push the engageable part 143*b* of the stopper 143 downward against the engageable grooves 11*c* on the bottom plate 11*a*; therefore, the engageable part 143*b* may clutch onto the engageable grooves 11*c* firmly, and the position of the guide plate 141 may be secured.

Further, the lever 142 in the second position may tilt in the direction to be separated away from the sheets S. Therefore, the lever 142 may be pushed easily, for example, by a thumb of a user.

Furthermore, the image forming apparatus 1 may have the urging part 142*g* arranged to project from the lever 142. The urging part 142*g* may contact the guide plate 141 and urge the lever 142 toward the first position.

Thus, even when the stopper 143 engages with bottom plate 11*a* at a position higher than an intended position due to, for example, an manufactural error, the stopper 143 may be prevented from colliding with the bottom plate 11*a* to produce rattling noise.

Furthermore, according to the image forming apparatus 1 described above, the tray body may be made of polystyrene resin, the guide plate 141 may be made of acrylonitrile-butadiene-styrene resin, and the lever 142 and the stopper 143 may be made of polyacetal resin.

With these materials, the tray body 11 and the stopper 143 may be less deformable; and the lever 142 and the stopper 143 may provide preferable abrasion-resistivity and smooth movability.

Second Embodiment of the Right-Side Guide

Below will be described a second embodiment of the right-side guide with reference to FIGS. 7A-7B. In the following description, items or structures which are identical or equivalent to those described in the previous embodiment may be referred to by the same reference signs, and explanation of those will be omitted.

A right-side guide 94 in the second embodiment includes a guide plate 941 with an upright portion 941*f*, in which a lever housing 941*g* to accommodate a lever 942 is formed. The lever housing 941*g* has a frontward face and a rearward face, and a guide groove 941*a* is formed on each of the frontward and rearward faces. The guide groove 941*a* on the frontward face and the guide groove (not shown) on the rearward face may be collectively called as the guide groove 941*a*. The guide groove 941*a* is an elongated hole having an upper section 941*c*, a lower section 941*d*, and a boss-introduction opening 941*e*, which are connected continuously. A boss 942*e* may be introduced to the guide groove 941*e* through the boss-introduction opening 941*e* in order to attach the lever 942 to the guide plate 941. The guide groove 941*a* may be in a curved form that curves lower-leftward in the upper section 941*c*, which is at an upper-rightward position, toward the lower section 941*d*, which is at a lower-leftward position, and curves lower-rightward in the lower section 941*d* toward the boss-introduction opening 941*e*. In the meantime, the form of the guide groove 941*a* may not necessarily be limited to the curved shape described above but may be, for example, in a convex shape rounded upward or downward, or, for another example, may be formed in straight lines.

Meanwhile, the lever 942 has the boss 942*e* to be inserted in the guide groove 941*a* on a frontward face and on a rearward face thereof. The boss 942*e* includes a boss 942*e* on the frontward face of the lever 942 and a boss (not shown) on the rearward face of the lever 942. In the following description, the boss 942*e* on the frontward face and the boss on the rearward face may be collectively called as the boss

942*e*. The boss 942*e* may be inserted in the guide groove 941*a* so that the guide groove 941*a* may support the lever 942 swingably.

Figure 7A:
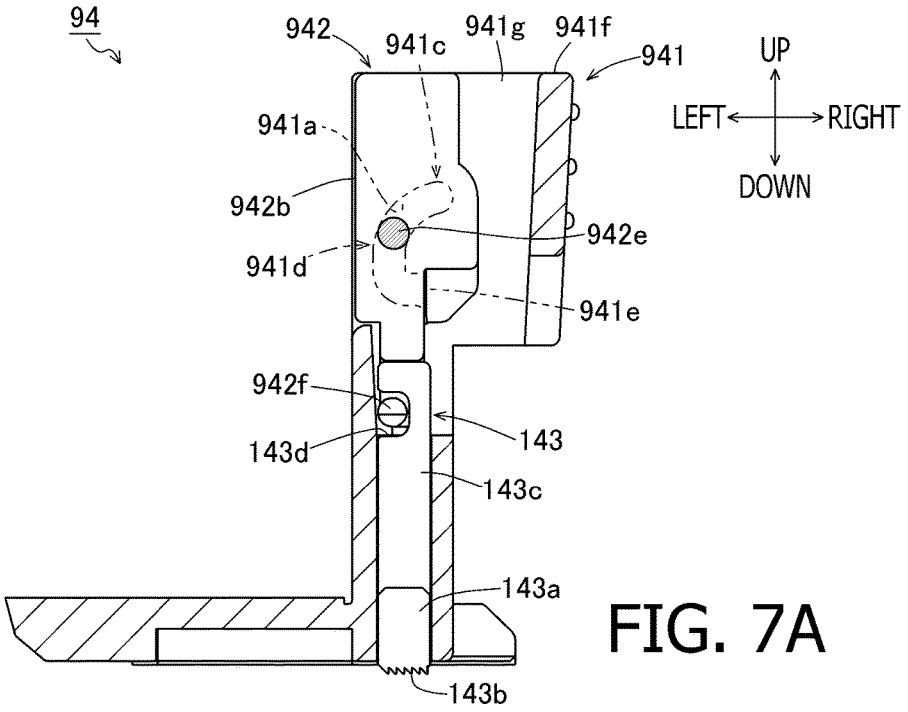
FIG. 7A is a leftward cross-sectional view of a right-side guide viewed from the right-hand side according to a second embodiment of the present disclosure with a lever not being operated.
Figure 7B:
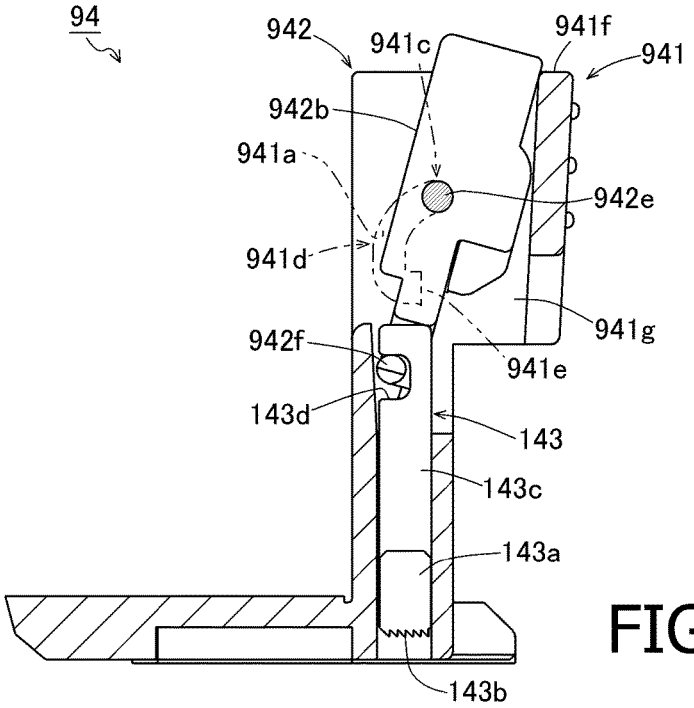
FIG. 7B is a leftward cross-sectional view of the right-side guide viewed from the right-hand side according to the second embodiment of the present disclosure with the lever being operated.

The lever 942 attached to the guide plate 941 may be placed in a first position, in which the lever 942 is in an upright posture (see FIG. 7A), and a second position, in which the lever 942 is in a tilted posture (see FIG. 7B). The boss 942*e* and the guide groove 941*a* enable the lever 942 to swing. Specifically, when the lever 942 is in the first position, the boss 942*e* is in the lower section 941*d* in the guide groove 941*a*; and when the lever 942 is in the second position, the boss 942*e* is in the upper section 941*c*.

When the user presses an operation face 942*b* outward, e.g., rightward, the guide groove 941*a* may move to relatively guide the boss 942*e* from the lower section 941*d* to the upper section 941*c*. Thereby, the lever 942 may be uplifted and tilt from the first position toward the second position.

[Behavior of the Right-Side Guide in the Modified Example]

While the lever 942 is not operated by the user, as shown FIG. 7A, the boss 942*e* is in the lower section 941*d* in the guide groove 941*a*; the lever 942 is in the upright posture in the first position; and the stopper 143 is lowered to the engaged position where the engageable part 143*b* engages with the engageable grooves 11*c*. In this state, the position of the right-side guide 14 is fixed.

The user may pinch the lever 942 by, for example, fingers of a right hand, and push the lever 942 with a thumb outward. When the lever 942 is pressed, the boss 942*e* may move with respect to the lever 942 along the guide groove 941*a* to reach the upper section 941*c* (see FIG. 7B). Meanwhile, the lever 942 together with the stopper 143 may be uplifted and pivot about the pivot shaft 942*f* to tilt rightward to be away from the sheets S in the tray body 11. When the stopper 143 ascends, the engageable part 143*b* may be moved from the engaged position to the separated position. In this state, the right-side guide 94 may be movable to slide in the widthwise direction so that the user may move the right-side guide 94 to a position to fit with the sheets S.

[Benefits]

According to the embodiment of the image forming apparatus 1 described above, the sheet tray 10 includes the tray body 11, in which sheets are stackable, the guide plate 941, the lever 942, the swingable device including the boss 942*e* and the guide groove 941*a* in which the boss 942*e* is inserted, and the stopper 143. The guide plate 941 may slidably move on the bottom plate 11*a* in the tray body 11 and contact edges of the sheets S to align at the predetermined position. The boss 942*e* is formed in lever 942, and the guide groove 941*a* is formed in the guide plate 941. The boss 942*e* may be guided in the guide groove 941*a* to move the lever 942 swingably. The stopper 143 is pivotably connected with the lever 942 through the hinge, which includes the pivot shaft 942*f* and the pivot groove 143*d*, and includes the engageable part 143*b* to engage with the bottom plate 11*a*. The boss 942*e* being guided in the guide groove 941*a* may move the lever 942 to swing between the first position, in which the boss 942*e* is in the lower section 941*d* in the guide groove 941*a*, and the stopper 143 is lowered to the engaged position where the engageable part 143*b* engages with the bottom plate 11*a*; and the second position, in which the boss 942*e* is in the upper section 941*c* in the guide groove 941*a*, and the stopper 143 is uplifted to the separated position where the engageable part 143*b* is separated from the bottom plate 11*a*. When the lever 942 is moved from the first position to the second position, the lever 942 may tilt by ascending and pivoting about the pivot shaft 942*f*.

In another aspect, the sheet tray 10 includes the tray body 11, in which sheets S are stackable, the guide plate 941, the stopper unit including the lever 942 and the stopper 143. The guide plate 941 may slidably move on the bottom plate 11*a* in the tray body 11 and contact the edges of the sheets S to align at the predetermined position. The stopper 143 is pivotably connected with the lever 142 and includes the engageable part 143*b* to engage with the bottom plate 11*a*. The lever 942 includes the boss 942*e*, and the guide plate 941 includes the guide groove 941*a*, in which the boss 942*e* is inserted. The boss 942*e* may be guided in the guide groove 941*a* to move the lever 942 swingably. The boss 942*e* being guided in the guide groove 941*a* may move the lever 942 to swing between the first position, in which the boss 942*e* is in the lower section 941*d* in the guide groove 941*a*, and the stopper 143 is lowered to the engaged position where the engageable part 143*b* engages with the bottom plate 11*a*; and the second position, in which the boss 942*e* is in the upper section 941*c* in the guide groove 941*a*, and the stopper 143 is uplifted to the separated position where the engageable part 143*b* is separated from the bottom plate 11*a*. When the lever 942 is moved from the first position to the second position, the lever 942 may tilt by ascending and pivoting.

With the lever 942, in which arrangement of the boss 942*e* and the guide groove 941*a* is inverted from the arrangement of the lever 142 described in the previous embodiment, the benefits achievable by the sheet tray 10 in the previous embodiment may be achieved as well.

Although examples of carrying out the invention has been described, those skilled in the art will appreciate that there are numerous variations and permutations of the sheet tray and the image forming apparatus that fall within the spirit and scope of the invention as set forth in the appended claims. It is to be understood that the subject matter defined in the appended claims is not necessarily limited to the specific features or act described above. Rather, the specific features and acts described above are disclosed as example forms of implementing the claims.

For example, the sheet tray may not necessarily be employed in a laser printer but may be employed in an inkjet printer. For another example, the sheet tray may not necessarily be employed in a single-functioned image forming apparatus but may be employed in a multifunction peripheral machine having, for example, an image reader.

What is claimed is:

1. A sheet tray, comprising:

a tray body comprising a bottom plate on which sheets are stackable; and a sheet guide disposed on the bottom plate, the sheet guide comprising:

a guide plate configured to slidably move on the bottom plate, the guide plate being configured to contact edges of the sheets on the bottom plate to align the sheets at a predetermined position;

a lever;

a swingable device comprising a boss and a guide groove in which the boss is inserted, one of the boss and the guide groove being formed in the guide plate, and the other of the boss and the guide groove being formed in the lever, the boss being configured to be guided in the guide groove to move the lever swingably; and a stopper pivotably connected with the lever through a hinge, the stopper comprising an engageable part configured to engage with the bottom plate, wherein the boss being guided in the guide groove moves the lever to swing between:

a first position, in which the boss is in a first section in the guide groove, and the stopper is lowered to an engaged position where the engageable part engages with the bottom plate; and a second position, in which the boss is in a second section in the guide groove, and the stopper is uplifted to a separated position where the engageable part is separated from the bottom plate; and wherein, when the lever is moved from the first position to the second position, the lever tilts by ascending and pivoting about a pivot axis of the hinge;

wherein the lever is pivotable in a direction to be closer to and farther from the sheets; and wherein the boss is located at an upper position with respect to the hinge when the lever is in the first position and in the second position.

2. The sheet tray according to claim 1, wherein the boss is formed in the guide plate, and the guide groove is formed in the lever;

wherein the guide groove comprises an upper section and a second section; and wherein, when the lever is in the first position, the boss is in the upper section, and when the lever is in the second position, the boss is in the lower section.

3. The sheet tray according to claim 1, wherein the guide groove is formed in the guide plate, and the boss is formed in the lever;

wherein the guide groove comprises an upper section and a second section; and wherein, when the lever is in the first position, the boss is in the lower section, and when the lever is in the second position, the boss is in the upper section.

4. The sheet tray according to claim 1, further comprising:

engageable grooves formed on the bottom plate, the engageable grooves being configured to engage with the engageable part when the lever is in the first position; and a resilient member configured to urge the engageable part against the engageable grooves.

5. The sheet tray according to claim 1, wherein the lever in the second position tilts in a direction to be separated away from the sheets.

6. The sheet tray according to claim 1, further comprising:

an urging part arranged to project from the lever, the urging part being configured contact the guide plate and urge the lever toward the first position.

7. The sheet tray according to claim 1, wherein the tray body is made of polystyrene resin;

wherein the guide plate is made of acrylonitrile-butadiene-styrene resin; and wherein the lever and the stopper are made of polyacetal resin.

8. An image forming apparatus, comprising:

an image forming unit configured to form images on sheets; and a sheet tray, comprising:

a tray body comprising a bottom plate on which the sheets are stackable;

a sheet guide disposed on the bottom plate, the sheet guide comprising:

a guide plate configured to slidably move on the bottom plate, the guide plate being configured to contact edges of the sheets on the bottom plate to align the sheets at a predetermined position;

a lever;

a swingable device comprising a boss and a guide groove in which the boss is inserted, one of the boss and the guide groove being formed in the guide plate, and the other of the boss and the guide groove being formed in the lever, the boss being configured to be guided in the guide groove to move the lever swingably; and a stopper pivotably connected with the lever through a hinge, the stopper comprising an engageable part configured to engage with the bottom plate, wherein the boss being guided in the guide groove moves the lever to swing between:

a first position, in which the boss is in a first section in the guide groove, and the stopper is lowered to an engaged position where the engageable part engages with the bottom plate; and a second position, in which the boss is in a second section in the guide groove, and the stopper is uplifted to a separated position where the engageable part is separated from the bottom plate; and wherein, when the lever is moved from the first position to the second position, the lever tilts by ascending and pivoting about a pivot axis of the hinge;

wherein the lever is pivotable in a direction to be closer to and farther from the sheets; and wherein the boss is located at an upper position with respect to the hinge when the lever is in the first position and in the second position.

9. The image forming apparatus according to claim 8, wherein the boss is formed in the guide plate, and the guide groove is formed in the lever;

wherein the guide groove comprises an upper section and a second section; and wherein, when the lever is in the first position, the boss is in the upper section, and when the lever is in the second position, the boss is in the lower section.

10. The image forming apparatus according to claim 8, wherein the guide groove is formed in the guide plate, and the boss is formed in the lever;

wherein the guide groove comprises an upper section and a second section; and wherein, when the lever is in the first position, the boss is in the lower section, and when the lever is in the second position, the boss is in the upper section.

11. The image forming apparatus according to claim 8, wherein the guide groove is formed in the guide plate, and the boss is formed in the lever;

wherein the guide groove comprises an upper section and a second section; and wherein, when the lever is in the first position, the boss is in the lower section, and when the lever is in the second position, the boss is in the upper section.

12. The image forming apparatus according to claim 8, further comprising:

engageable grooves formed on the bottom plate, the engageable grooves being configured to engage with the engageable part when the lever is in the first position; and a resilient member configured to urge the engageable part against the engageable grooves.

13. The image forming apparatus according to claim 8, wherein the lever in the second position tilts in a direction to be separated away from the sheets.

14. The image forming apparatus according to claim 8, further comprising:

an urging part arranged to project from the lever, the urging part being configured contact the guide plate and urge the lever toward the first position.

15. The image forming apparatus according to claim 8, wherein the tray body is made of polystyrene resin;

wherein the guide plate is made of acrylonitrile-butadiene-styrene resin; and wherein the lever and the stopper are made of polyacetal resin.

16. A sheet tray, comprising:

a tray body comprising a bottom plate on which sheets are stackable; and a sheet guide disposed on the bottom plate, the sheet guide comprising:

a guide plate configured to slidably move on the bottom plate, the guide plate being configured to contact edges of the sheets on the bottom plate to align the sheets at a predetermined position; and a stopper unit comprising a lever and a stopper pivotably connected with the lever, the stopper comprising an engageable part configured to engage with the bottom plate, wherein the guide plate comprises one of a boss and a guide groove in which the boss is inserted, and the lever comprises the other of the boss and the guide groove, the boss being configured to be guided in the guide groove to move the lever swingably;

wherein the boss being guided in the guide groove moves the lever to swing between:

a first position, in which the boss is in a first section in the guide groove, and the stopper is lowered to an engaged position where the engageable part engages with the bottom plate; and a second position, in which the boss is in a second section in the guide groove, and the stopper is uplifted to a separated position where the engageable part is separated from the bottom plate;

wherein, when the lever is moved from the first position to the second position, the lever tilts by ascending and pivoting;

wherein the lever is pivotable in a direction to be closer to and farther from the sheets; and wherein the boss is located at an upper position with respect to a connecting portion connecting the lever with the stopper when the lever is in the first position and in the second position.

17. The sheet tray according to claim 16, wherein the boss is formed in the guide plate, and the guide groove is formed in the lever;

wherein the guide groove comprises an upper section and a second section; and wherein, when the lever is in the first position, the boss is in the upper section, and when the lever is in the second position, the boss is in the lower section.

18. The sheet tray according to claim 16, wherein the guide groove is formed in the guide plate, and the boss is formed in the lever;

wherein the guide groove comprises an upper section and a second section; and wherein, when the lever is in the first position, the boss is in the lower section, and when the lever is in the second position, the boss is in the upper section.

19. A sheet tray, comprising:

a tray body, in which sheets are stackable;

a guide plate comprising one of a boss and a guide portion in which the boss is arranged, the guide plate being slidable on a bottom plate in the tray body, the guide plate being configured to contact edges of the sheets on the bottom plate to align the sheets at a predetermined position;

a lever comprising the other of the boss and the guide portion, the lever being configured to swing by the boss moving guided in the guide portion; and a stopper comprising a contacted portion, the contacted portion being configured to be contacted by a contacting portion arranged in the lever, and an engageable portion, the engageable portion being engageable with the bottom plate, wherein, when the lever stands upright, the lever is located at a first position, in which the contacting portion locates the contacted portion at a lower position, and in which the engageable portion is located at an engageable position to engage with the bottom plate;

wherein, when the lever tilts in a direction to be separated away from the sheets, the lever is located at a second position, in which the contacting portion moves the contacted portion at an upper position, and in which the engageable portion is located at a separated position to be separated from the bottom plate; and wherein, when the lever is located at the second position, the contacted portion and the contacting portion are arranged on an inner side of the boss, and an upper end of the lever is arranged on an outer side of the boss.

* * * * *